US011858681B2

(12) United States Patent
Hasegawa et al.

(10) Patent No.: US 11,858,681 B2
(45) Date of Patent: Jan. 2, 2024

(54) CAN BODY AND METHOD OF MANUFACTURING THEREOF

(71) Applicant: UNIVERSAL CAN CORPORATION, Tokyo (JP)

(72) Inventors: Takashi Hasegawa, Sunto-gun (JP); Tomoaki Iimura, Sunto-gun (JP)

(73) Assignee: UNIVERSAL CAN CORPORATION, Tokyo (JP)

( * ) Notice: Subject to any disclaimer, the term of this patent is extended or adjusted under 35 U.S.C. 154(b) by 0 days.

(21) Appl. No.: 17/273,197

(22) PCT Filed: Jan. 27, 2020

(86) PCT No.: PCT/JP2020/002652
§ 371 (c)(1),
(2) Date: Mar. 3, 2021

(87) PCT Pub. No.: WO2020/158634
PCT Pub. Date: Aug. 6, 2020

(65) Prior Publication Data

US 2021/0323713 A1 Oct. 21, 2021

(30) Foreign Application Priority Data

Jan. 28, 2019 (JP) ..... 2019-011928

(51) Int. Cl.
*B65D 1/46* (2006.01)
*B21D 51/38* (2006.01)
(Continued)

(52) U.S. Cl.
CPC ..... *B65D 1/46* (2013.01); *B21D 51/38* (2013.01); *B65D 1/023* (2013.01); *B65D 1/165* (2013.01); *B65D 2501/0009* (2013.01)

(58) Field of Classification Search
CPC ..... B65D 1/02; B65D 1/023; B65D 1/0246; B65D 1/16; B65D 1/165; B65D 3/30;
(Continued)

(56) References Cited

U.S. PATENT DOCUMENTS 4,513,872 A * 4/1985 Bull ..... B21D 51/2646 220/658
5,544,808 A * 8/1996 Aloisi ..... B65D 3/28 229/4.5

(Continued)

FOREIGN PATENT DOCUMENTS

JP 2004-175386 A 6/2004
JP 2005-46855 A 2/2005

(Continued)

OTHER PUBLICATIONS

International Search Report dated Mar. 24, 2020 for the corresponding PCT Application No. PCT/JP2020/002652.

(Continued)

*Primary Examiner* — Robert Poon
(74) *Attorney, Agent, or Firm* — Leason Ellis LLP; Melvin C. Garner; Mitsuhiro Haraguchi

(57) ABSTRACT

Provided is a can body in which a skirt part of the cap attached to a curl part certainly wraps to fixable and pressure resistance can be improved. A cylindrical part and a mouth part connected with a neck part with a smaller diameter than the cylindrical part are provided with; the mouth part has a curl part at an outer peripheral part which is made by folding a tip outward in a radial direction to round up; and in a vertical cross section on a can axis, a concave part is formed toward a lower side in the can axis direction, between an outer peripheral-lower side bent part which is convex diagonally downward on an outer peripheral part of the curl part and a curl end part having the tip.

13 Claims, 10 Drawing Sheets

(51) Int. Cl.
*B65D 1/02* (2006.01)
*B65D 1/16* (2006.01)

(58) Field of Classification Search
CPC ... B65D 3/04; B65D 7/04; B65D 7/44; B65D 11/04; B65D 11/22; B65D 13/02; B65D 2501/0009
USPC ..... 220/657–659, 656, 641
See application file for complete search history.

(56) References Cited

U.S. PATENT DOCUMENTS

| | | | | |
|---|---|---|---|---|
| 7,497,350 | B2 * | 3/2009 | Enoki | B65D 7/04 220/619 |
| 2004/0084459 | A1 * | 5/2004 | Brown | B29C 45/4407 220/659 |
| 2005/0115294 | A1 | 6/2005 | Kanou et al. | |
| 2012/0024813 | A1 * | 2/2012 | Nakagawa | B65D 1/0207 215/40 |
| 2020/0156139 | A1 * | 5/2020 | Ross | B21H 3/046 |
| 2020/0172282 | A1 * | 6/2020 | Hasegawa | B65D 1/0246 |

FOREIGN PATENT DOCUMENTS

| | | | |
|---|---|---|---|
| JP | 2011-116456 | A | 6/2011 |
| JP | 2012-192984 | A | 10/2012 |
| WO | WO-01/38185 | A1 | 5/2001 |
| WO | WO-2007/122971 | A1 | 11/2007 |
| WO | 2018211993 | A1 | 11/2018 |

OTHER PUBLICATIONS

Extended European Search Report dated Sep. 27, 2022 for the corresponding European Patent Application No. 20748990.7 (7 pages).

* cited by examiner

CAN BODY AND METHOD OF MANUFACTURING THEREOF

CROSS-REFERENCE TO RELATED PATENT APPLICATIONS

This application is a U.S. National Phase Application under 35 U.S.C. § 371 of International Patent Application No. PCT/JP2020/002652 filed on Jan. 27, 2020 and claims the benefit of priority to Japanese Patent Application No. 2019-11928, filed Jan. 28, 2019, all of which are incorporated herein by reference in their entireties. The International Application was published in Japanese on Aug. 6, 2020 as International Publication No. WO/2020/158634 under PCT Article 21(2).

BACKGROUND OF THE INVENTION

Field of the Invention

The present invention relates to a can body having a bottle shape in which a curl part is formed on an opening part to which a cap is put on and a method of manufacturing thereof.

Background of the Invention

As a container which is filled with contents such as a beverage, known is a structure of a can body (a bottle can) made of steel or aluminum alloy on which a cap is put on an opening part to seal by a liner on an inner of the cap. In such a can body, a container is proposed which has a curl part having a shape similar to that of a bottle mouth at its opening part, and is sealed by fitting a skirt part of the cap to the curl part. The can body used for this container a relatively large curl part with respect to the opening part of the can body.

For example, International Publication No. 2007/122971 discloses a metal can in which a cap which can be opened by tearing a score by pulling a tab is seamed to be fixed on a bead part (a curl part) formed by curling a tip end of a mouth part outward. In this metal can, the mouth part extends linearly, the bead part (the curl part) is inclined inward, and an inclination start position of the bead part is set between a lower end part of the bead part and a curl start position. The curled tip part of the bead part (the curl part) abuts against an outer surface of the mouth part almost vertically.

In a metal bottle can disclosed in Japanese Unexamined Patent Application, First Publication No. 2011-116456, a curl part is formed to have a diameter-reduction part reducing in a diameter from an upper end of a mouth part, a stand-up part extending upward from an upper end of the diameter-reduction part, an upper bent part at an upper end of the stand-up part, a bent part smoothly expanding outward and extending downward from the upper bent part to protrude outward, a lower bent part at a lower end of the bent part, and a straight linear part extending linearly from the lower bent part to the diameter-reduction part. The tip end of the straight linear part abuts against an outer surface of the diameter-reduction part. It is described that an incline angle of the diameter-reduction part is 25° to 65°, a radius of curvature of the upper bent part is 0.5 to 1.0 mm, a radius of curvature of the bent part is 2.0 to 3.0 mm, a radius of curvature of the lower bent part is 0.5 to 1.0 mm, and an angle of the straight linear part with the horizontal is 0° to 25°.

CITATION LIST

Patent Literature

Patent Document 1: International Publication No. 2007/122971

Patent Document 2: Japanese Unexamined Patent Application, First Publication No. 2011-116456

Technical Problem

Such curl part is formed relatively large with a similar shape to a bottle mouth. Therefore, the radius of curvature at the lower end of the curl part to which the skirt part of the cap is rolled in is easily increased, and pressure resistance after the skirt part of the cap is mounted may be deteriorated.

The present invention is achieved in consideration of the above circumstances, and has an object to provide a can body in which the skirt part of the cap mounted to the curl part can be reliably rolled in and fixed and the pressure resistance can be increased.

SUMMARY OF THE INVENTION

Solution to Problem

A can body of the present invention is a can body having a cylindrical part, a neck part smaller than the cylindrical part in a diameter, and a mouth part connected to the neck part. The mouth part has on an outer peripheral part thereof a curl part in which an end part including an edge is folded back outward in a radial direction and rolled up; the curl part is provided with an outer peripheral-lower side bent part which is bent inward in the radial direction at an outer peripheral lower part and convex diagonally downward in a can axis direction, a concave part which is connected to the outer peripheral-lower side bent part and concave downward in the can axis direction, and a curl end part which is connected to the concave part and includes the edge.

Since the concave part is formed between the outer peripheral-lower side bent part and the curl end part in the curl part, it is possible to reduce a radius of curvature of the outer peripheral-lower side bent part. Moreover, rigidity is high since the convex part and the concave part of the outer peripheral-lower side bent part are formed to be connected, the skirt part of the cap is favorably rolled up, and pressure resistance is improved. In addition, the concave part may not be necessarily formed in whole circumference.

As one aspect of the can body of the present invention, a radius of curvature on an outer surface of the outer peripheral-lower side bent part is preferably not less than 0.4 mm and not more than 1.2 mm, more preferably not less than 0.5 mm and not more than 0.8 mm.

By setting the radius of curvature on the outer surface of the outer peripheral-lower side bent part in this range, it is possible to certainly fix the skirt part by holding when the skirt part of the cap is rolled in.

As another aspect of the can body of the present invention, it is preferable that the curl end part have an end bent part which is gradually reduced in a diameter upward in the can axis direction from the inside of the concave part in the radial direction and curved to be convex inward in the radial direction.

The rigidity is improved since the curl end part is curved with the small radius of curvature by the end bent part; moreover, even if the curl end part is pressed against the outer peripheral surface of the mouth part starting end part by an inward external force in the radial direction when the skirt of the cap is rolled in, the edge is not easily in contact with the mouth part starting end part since the end bent part is convex inward in the radial direction, so that the mouth part starting end part is not easily damaged.

A method of manufacturing a can body of the present invention has a forming step of a small-diameter cylinder part forming a small-diameter cylinder part in a cylindrical body; and a forming step of a curl part forming a curl part which is formed by folding an end part including an edge of the small-diameter cylinder part outward in a radial direction and rounding up; the forming step of the curl part has a rolling step forming a roll part by folding the end part of the small-diameter cylinder part outward in the radial direction and rounding it, and a throttle step forming the curl part having an outer peripheral-lower side bent part which is convex diagonally downward by pressing an outer peripheral part of the roll part from the outside in the radial direction after the rolling step; and in the throttle step, a vicinity of the edge abuts an outer peripheral surface of the small-diameter cylindrical part to press inward from an outside in the radial direction, so that the outer peripheral-lower side bent part, a concave part which is connected to the outer peripheral-lower side bent part and curved to be concave downward in the can axis direction, and a curl end part which is connected to the concave part and includes the edge are formed.

Since the curl end part has the edge, it is relatively hard and not easily deformed. Therefore, pressing the roll part from the outside in the radial direction with abutting the vicinity of the edge against the outer surface of the small-diameter cylindrical part in the throttle step, so that the concave part can be formed between the curl end part which is not easily deformed and the outer peripheral-lower side bent part. Due to this formation of the concave part the radius of curvature of the outer peripheral-lower side bent part is small, so that the skirt part of the cap can firmly wrap.

As one aspect of the manufacturing method of the can body of the present invention, it is preferable to further include a pre-curling step forming a pre-curl part by folding back the vicinity of the edge of the small-diameter cylindrical part outward in a predetermined radius of curvature between the forming step of the small-diameter cylindrical part and the forming step of the curl part; and that in the rolling step, an upper part of the roll part be formed by folding back and rounding the small-diameter cylindrical part at a lower part than the pre-curl part with a larger radius of curvature than the predetermined radius of curvature.

The pre-curl part is formed with relatively a small radius of curvature, so that the rigidity of the curl end part is further improved and the concave part can be easily formed in the throttle step.

Advantageous Effects of Invention

According to the present invention, it is possible to firmly fix by wrapping the skirt part of the cap attached to the curl part and improve the pressure resistance.

DETAILED DESCRIPTION OF THE INVENTION

Figure 1:
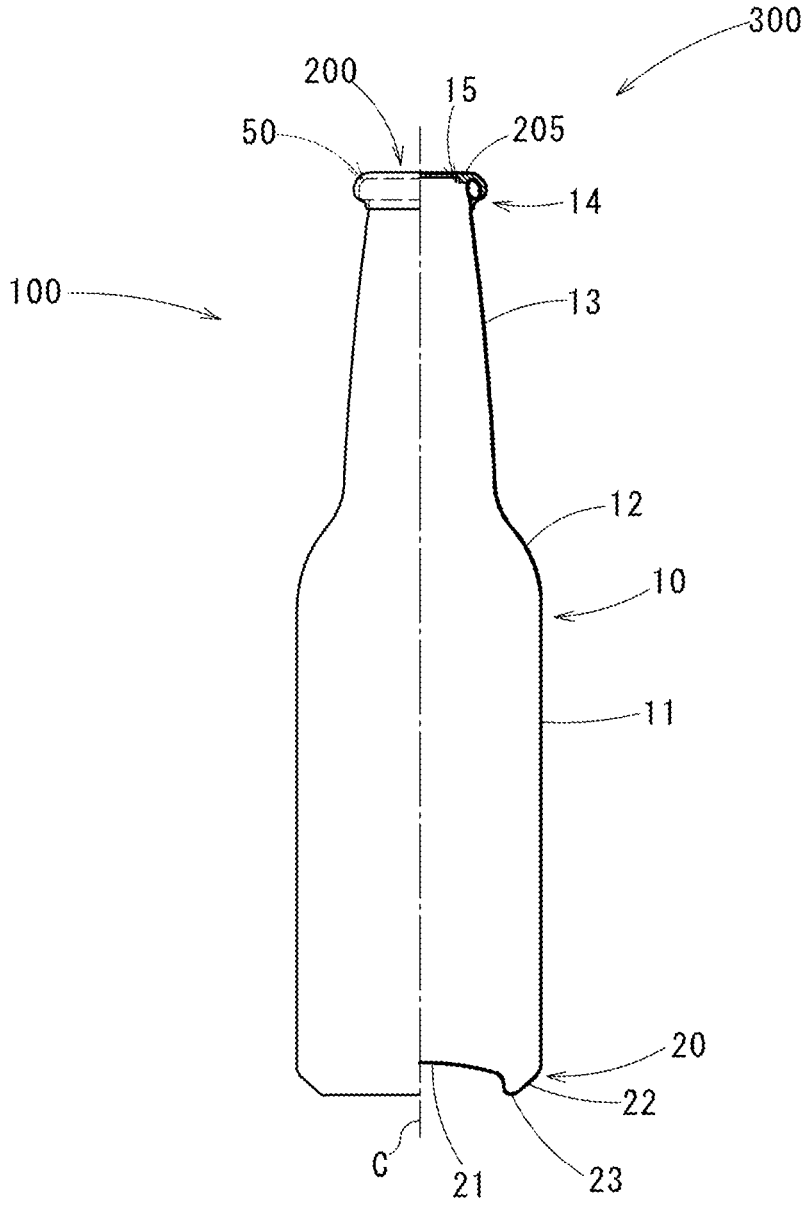
FIG. 1 is a frontal view of a bottle container using a can body of one embodiment of the present invention in which a right half is made into a cross section on a can axis.
Figure 4:
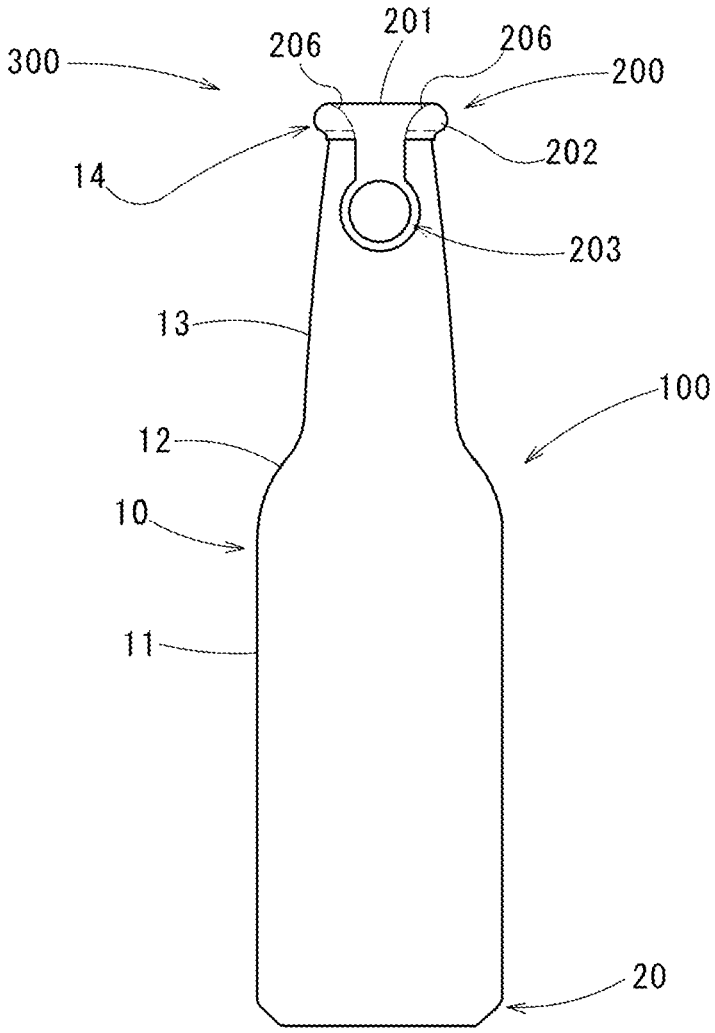
FIG. 4 is a frontal view seen at a different angle of the bottle container in FIG. 1.
Figure 5:
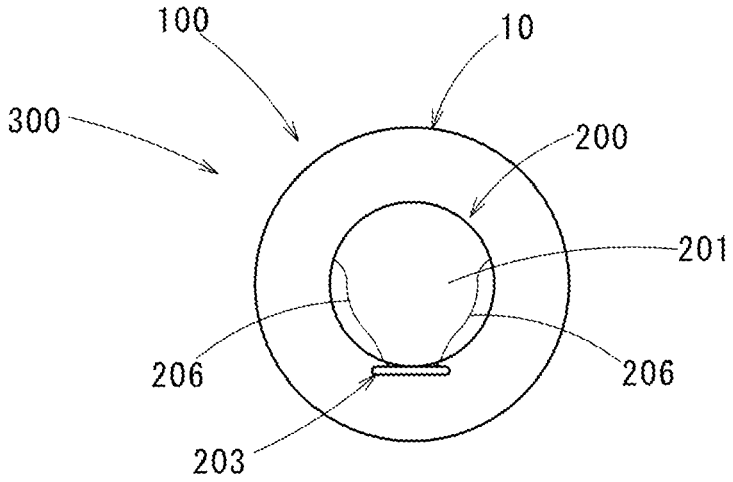
FIG. 5 is a top view of the bottle container.

Below, an embodiment of a can body according to the present invention will be explained referring to drawings. A can body 100 of the present embodiment is a bottle can formed as a bottle shape in a whole as shown in FIG. 1, FIG. 4 and FIG. 5, and has a curl part 50 to form an opening part 15 opening outward in a mouth part 14 at an upper end thereof. The can body 100 is filled with a content such as a beverage through the opening part 15, is sealed by mounting a cap 200 on the mouth part 14 at the opening part 15, and becomes a bottle container 300.

FIG. 1, FIG. 4 and FIG. 5 show the bottle container 300 which is provided with the can body 100 and the cap 200 mounted on the mouth part 14 of the can body 100. In FIG. 1, a cross section on a can axis C is shown in a right half of the bottle container 300.

The can body 100 is made of a thin metal sheet such as aluminum or aluminum alloy, formed to be a straight shape to a middle position in a height direction as shown in FIG. 1, and formed in a cylindrical shape with a bottom provided with a trunk part 10 forming a cylindrical shape reducing in a diameter at the upper part toward the opening part 15 and a bottom part 20 closing an bottom part of the trunk part 10.

As shown in FIG. 1, the trunk part 10 and the bottom part 20 are arranged to have the same axis; in the present embodiment, the explanation is carried out with calling the common axis to them as the can axis C. Between directions along the can axis C (a can axis direction), a direction from the opening part 15 to the bottom part 20 is set to a lower side (downward) and a direction from the bottom part 20 to the opening part 15 is set to an upper side (upward); in the explanation below, the up/down directions are set as in the directions shown in FIG. 1. A direction orthogonal to the can axis C is a radial direction; among the radial direction, a direction to come near the can axis C is an inside of the radial direction (inward) and a direction to leave the can axis C is an outside of the radial direction (outward). A direction surrounding the can axis C is a circumferential direction.

In this embodiment, the bottom part 20 of the can body 100 has a dome part 21 arranged on the can axis C and expanding upward (toward the inside of the trunk part 10) and a heel part 22 connecting an outer peripheral of the dome part 21 and the lower end of the trunk part 10. The connection part between the dome part 21 and the heel part 22 is a ground part 23 abutting on a ground surface when arranged on the ground surface (a carrying surface) so that the can body 100 is in an upright position (a position in which the opening part 15 is upward shown in FIG. 1). The ground part 23 protrudes downward most in the bottom part 20 and is annular extending along a peripheral direction.

As shown in FIG. 1, the trunk part 10 of the can body 100 has a cylindrical part 11 formed in a cylindrical shape at a bottom side (the bottom part 20 side) of the trunk part 10, a shoulder part 12 reducing in a diameter upward in the can axis direction to bend radially inward at the upper end of the cylindrical part 11, a thin and long neck part 13 having a smaller diameter than that of the cylindrical part 11 and connected to the upper end of the shoulder part 12 to extend upward, and the mouth part 14 connected to the upper end of the neck part 13 and opens outside. The cylindrical part 11, the shoulder part 12, the neck part 13, and the mouth part 14 respectively form an annular shape extending over a whole circumference of the peripheral direction of the trunk part 10.

The neck part 13 has a shape of gradually reducing a diameter upward in the can axis; the diameter is smaller than that of the cylindrical part 11 and the upper end of the neck part 13 is the smallest diameter. A height of the neck part 13 (a dimension in the can axis direction) is slightly smaller than a height of the cylindrical part 11 (a dimension in the can axis direction). In the can body 100 of this embodiment, the neck part 13 is connected to the top end of the shoulder part 12 and has a tapered pipe shape gradually reducing in the diameter upward in the can axis direction. A top end part 13*a* of the neck part 13 has a small angle with the can axis C and is almost along the can axis direction (refer to FIG. 2). To the upper end of the top end part 13*a* of the neck part 13, the mouth part 14 is connected.

Figure 2:
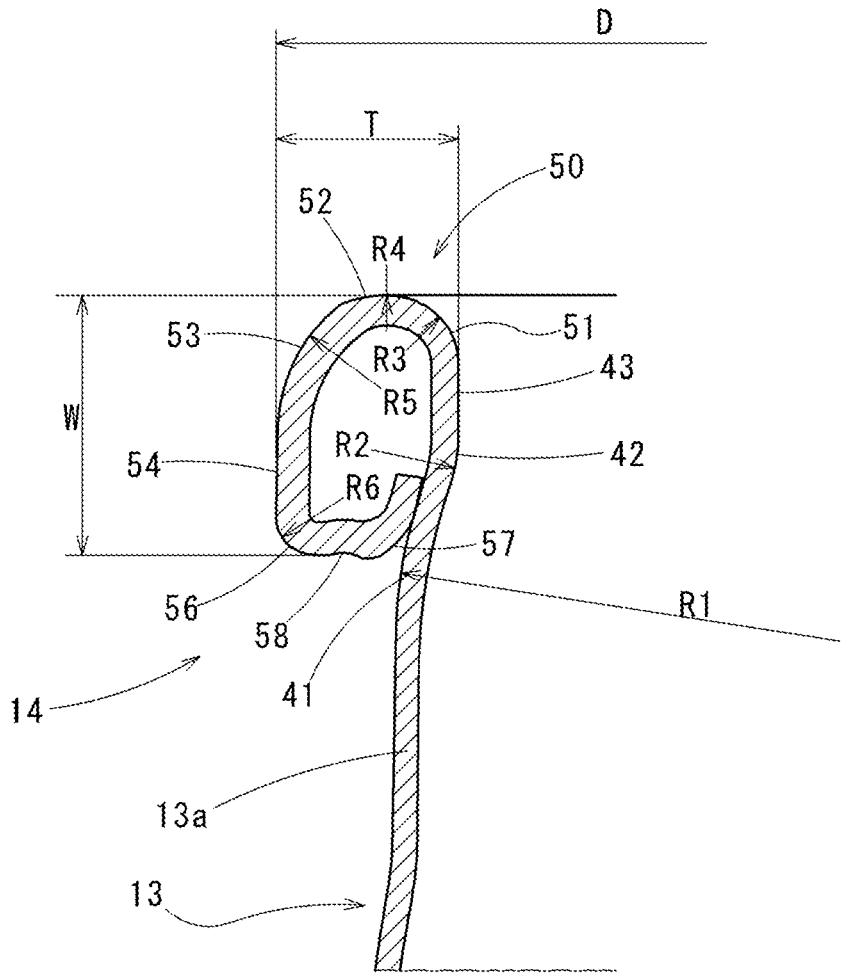
FIG. 2 is an enlarged cross section of a vicinity of a curl part of the can body shown in FIG. 1.

The mouth part has the curl part 50 formed on an outer peripheral part by folding outward in the radial direction an edge part including an edge. Specifically, as shown in FIG. 2, the mouth part 14 has a mouth part starting end part 41 connected to the top end part 13*a* of the neck part 13 and curved to swell out in the radial direction with reducing the diameter upward in the can axis direction, an inner peripheral-lower side bent part 42 curved to convex inward in the radial direction from the top end of the mouth part starting end part 41, an inner peripheral side cylindrical part 43 connected to the top end of the inner peripheral-lower side bent part 42 and extending vertically upward in the can axis direction at an innermost position of the mouth part 14, and the curl part 50 connected to the top end of the inner peripheral side cylindrical part 43 and folded outward in the radial direction. In the cross section (a vertical cross section) on the can axis C in the can axis direction, the inner peripheral side cylindrical part 43 is arranged substantially parallel to the can axis C.

The mouth part starting end part 41 swells out in the radial direction and a radius of curvature R1 (mm) of the outer surface (a convex surface) is not less than 6.3 mm and not more than 10.3 mm. The inner peripheral-lower side bent part 42 swells out in the radial direction and a radius of curvature R2 (mm) of the outer surface (a convex surface) is not less than 1.0 mm and not more than 5.0 mm.

In the curl part 50, in FIG. 2 showing a cross section (a vertical cross section) on the can axis C along the can axis direction, continued are: an inner peripheral-upper side bent part 51 bent to spread outward in the radial direction from the top end of the inner peripheral side cylindrical part 43; a folded top part 52 folded from the outer peripheral edge of the inner peripheral-upper side bent part 51 and bent to protrude upward in the can axis direction; an outer peripheral-upper side bent part 53 bent downward in the can axis direction from the outer peripheral edge of the folded top part 52; an outer peripheral side cylindrical part 54 extending downward in the can axis direction from the outer peripheral edge of the outer peripheral-upper side bent part 53; an outer peripheral-lower side bent part 56 bent inward in the radial direction from the lower end of the outer peripheral side cylindrical part 54 and convex diagonally outward and downward in the can axis direction; a concave part 58 continuing from an inner peripheral of the outer peripheral-lower side bent part 56 and concave downward in the can axis; and a curl end part 57 continuing from the concave part 58 to include an edge and bent to convex substantially downward.

The curl end part 57 is further provided with an end bent part 57*a* gradually reducing in the diameter upward in the can axis direction from the inside of the concave part 58 in the radial direction and bent to be convex inward in the radial direction.

The outer peripheral-lower side bent part 56 and the curl end part 57 are bent to be convex substantially downward; and the concave part 58 is formed between the outer peripheral-lower side bent part 56 and the curl end part 57 along the peripheral direction. It is not necessary for the concave part 58 to be formed continuously in the peripheral direction but it may be formed intermittently. In a case in which the concave part 58 is formed intermittently in the peripheral direction, it is a form in which the concave part 58 and a convex part 59 which is formed by continuously arranging the outer peripheral-lower side bent part 56 and the curl end part 57 are adjacent in the peripheral direction.

The folded top part 52 arranged between the inner peripheral-upper side bent part 51 and the outer peripheral-upper side bent part 53 is arranged at the peak of the curl part 50. A radius of curvature R3 (mm) of an outer surface (a convex surface) of the inner peripheral-upper side bent part 51 is not less than 0.8 mm and not more than 1.4 mm; a radius of curvature R4 (mm) of an outer surface (a convex surface) of the folded top part 52 is not less than 1.5 mm and not more than 2.5 mm; and a radius of curvature R5 (mm) of an outer surface (a convex surface) of the outer peripheral-upper side bent part 53 is not less than 2.4 mm and not more than 3.0 mm.

Figure 3:
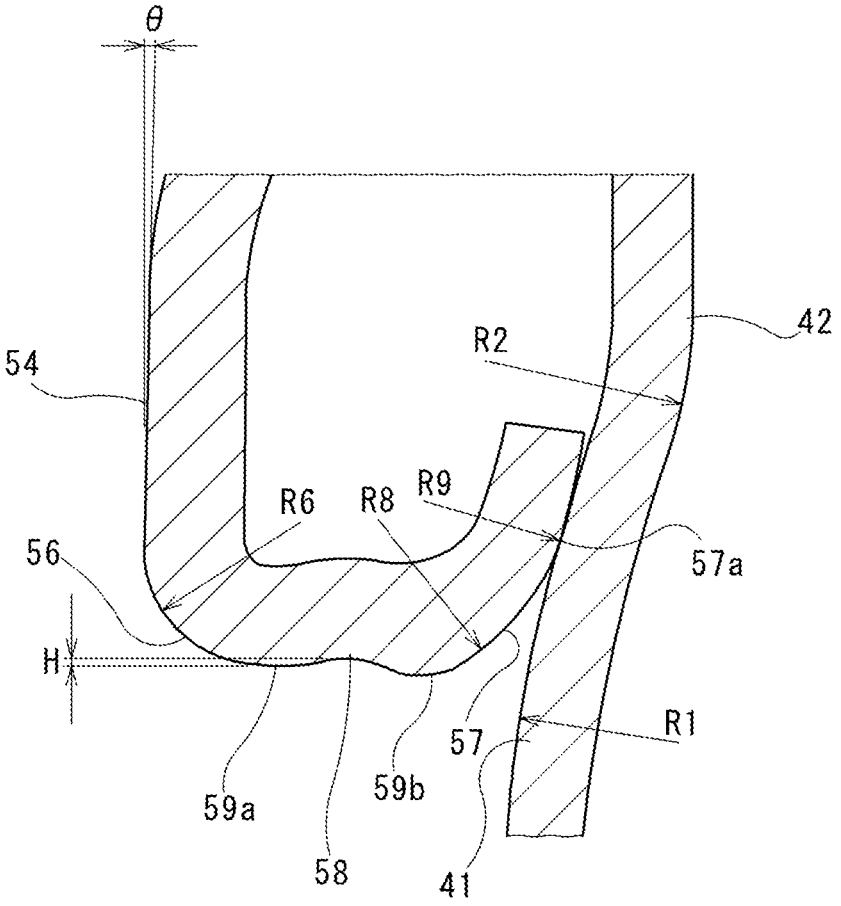
FIG. 3 is a cross section of a further enlarged vicinity of a lower part of the curl part shown in FIG. 2.

In this embodiment, as shown in FIG. 3, the outer peripheral side cylindrical part 54 is formed to be slightly increasing in the diameter downward in the can axis; and an incline angle thereof is an angle not less than 1.2° and not more than 1.8° with the can axis C. Accordingly, a lower end of the outer peripheral side cylindrical part 54, in other words, a top end of the outer peripheral-lower side bent part 56 is the maximum diameter part of the curl part 50. A radius of curvature R6 (mm) of an outer surface (a convex surface) of the outer peripheral-lower side bent part 56 is preferably not less than 0.4 mm and not more than 1.2 mm, more preferably 0.5 mm to 0.8 mm.

In the outer surface of the curl part 50, if the radius of curvature R5 of the outer peripheral-upper side bent part 53 excesses 3.0 mm, the sealing performance may be deteriorated; and if it is less than 2.4 mm, breakages and wrinkles may be generated when the curl part 50 is formed. If the radius of curvature R6 of the outer peripheral-lower side bent part 56 excesses 1.2 mm, a skirt part 202 of the cap 200 may be weakly rolled in. While, if the radius of curvature R6 is less than 0.4 mm, the breakages and the wrinkles may be generated on the curl part 50 in a forming step of 50.

The curl end part 57 is curved to gradually reduce the diameter upward in the can axis direction from the inside in the radial direction of the concave part 58 and to be convex inward in the radial direction; a radius of curvature R8 (mm) of an outer surface (a convex surface) thereof is not less than 1.0 mm and not more than 4.0 mm. In this embodiment, only the end bent part 57*a* of the curl end part 57 is formed to be even smaller in the radius of curvature. A radius of curvature R9 (mm) of the end bent part 57*a* is not less than 0.8 mm and not more than 3.0 mm. The outer surface (the convex surface) of the curl end part 57 is formed as a convex outer surface in which the curved surface with the radius of curvature R8 and the curved surface with the radius of curvature R9 are continued. The radii of curvature R8 and R9 of the curl end part 57 may be the same dimension.

Since the mouth part starting end part 41 is also curved to be convex outward in the radial direction as described above, the outer surface thereof forms a convex outer surface. Accordingly, the convex outer surface of the end bent part 57*a* is in contact with the convex outer surface of the mouth part starting end part 41.

The concave part 58 is formed to connect between the inside in the radial direction of the outer peripheral-lower side bent part 56 and the outside in the radial direction of the curl end part 57. On both sides (the inside and the outside) in the radial direction of the concave part 58, a convex part 59*a* of the outer peripheral-lower side bent part 56 which is convex downward in the can axis direction and a convex part 59*b* of the curl end part 57 which is convex downward in the can axis direction are formed.

A depth H of the concave part 58 in the can axis direction is a distance measured vertically from a line connecting a top point of the convex part 59*a* and a top point of the convex part 59*b* (a tangent line of the convex part 59*a* and the convex part 59*b*) in a cross section involving the can axis C, to a deepest part of an inner surface of the concave part 58. It is formed to be 0.01 mm or more and 0.30 mm or less, more preferably 0.01 mm to 0.20 mm. A radius of curvature of the convex part 59*a* may be the same radius of curvature as the radius of curvature R6 of the outer peripheral-lower side bent part 56; and it may also be slightly larger or smaller than the radius of curvature R6. A radius of curvature of the convex part 59*b* may be the same radius of curvature as the radius of curvature R8 of the curl end part 57; and it may also be slightly larger or smaller than the radius of curvature R6.

As shown in FIG. 2, in a cross section on the can axis C along the can axis direction, an upper end outer surface of the folded top part 52 is disposed on a top end position of the curl part 50 in the can axis direction. While, in the outer surface at the lower end of the curl part 50, the convex part 59*b* on the inside in the radial direction is arranged at the lower position in the can axis direction than the convex part 59*a* on the outside in the radial direction of the concave part 58; the convex part 59*b* is arranged at the lowest end position in the can axis direction of the curl part 50. However, a width W (mm) in the can axis direction of the curl part 50 is a vertical distance parallel to the can axis C from the top end position of the curl part 50 to the lowest position of the convex part 59*a* along the can axis direction.

A thickness T (mm) in the radial direction of the curl part 50 is a horizontal distance orthogonal to the can axis C from the radially-innermost position to the radially-outermost position of the curl part 50 in the radial direction. In the vertical cross section on the can axis C along the can axis direction shown in FIG. 2, the start end of the inner peripheral-upper side bent part 51, in other words the top end position of the inner peripheral side cylindrical part 43 is arranged at the radially-innermost position of the curl part 50; and a connected position of the outer peripheral side cylindrical part 54 and the outer peripheral-lower side bent part 56 (the lower end of the outer peripheral side cylindrical part 54 or the top end of the outer peripheral-lower side bent part 56) is arranged at the radially-outermost position of the curl part 50. That is to say, the thickness T of the curl part 50 is a horizontal distance from the outer surface (an inner peripheral surface) at the start end of the inner peripheral-upper side bent part 51 to the connected position of the outer peripheral side cylindrical part 54 and the outer peripheral-lower side bent part 56.

In this embodiment, where an outer diameter of the curl part 50 is D (mm), a ratio (T/D) of the outer diameter D and the thickness T is not less than 0.07 and not more than 0.12; and the thickness T of the curl part 50 is formed in a size not less than 7% and not more than 12% of the outer diameter D. Specifically, for example, in the can body 100 in which the outer diameter D of the curl part 50 is not less than 25 mm and not more than 40 mm, the thickness T of the curl part 50 is not less than 2.0 mm and not more than 4.5 mm, preferably not less than 3.0 mm and not more than 4.0 mm. The width W of the curl part 50 is not less than 3.0 mm and not more than 5.0 mm, preferably not less than 3.5 mm and not more than 4.7 mm.

In this embodiment, as shown in FIG. 2 and FIG. 3, the outer peripheral side cylindrical part 54 is formed to gradually increase the diameter downward in the can axis direction; but it may be formed to be parallel to the can axis direction. Alternately, it may be formed into a curved surface which gradually increases the diameter downward in the can axis and gently curves outward in the radial direction with a sufficiently larger radius of curvature than the radius of curvature R5 of the outer peripheral-upper side bent part 53. That is to say, the outer peripheral side cylindrical part 54 is formed into a surface of a straight linear shape in the vertical cross section on the can axis C or a curved shape slightly convex outward in the radial direction with a larger radius of curvature than the radius of curvature R5 on the outer surface of the outer peripheral-upper side bent part 53.

A sheet thickness of the can body 100 is not necessarily limited; an original sheet thickness of an aluminum alloy sheet before forming is 0.250 mm to 0.5 mm and the sheet thickness at the curl part 50 is 0.200 mm to 0.600 mm.

Figure 6A:
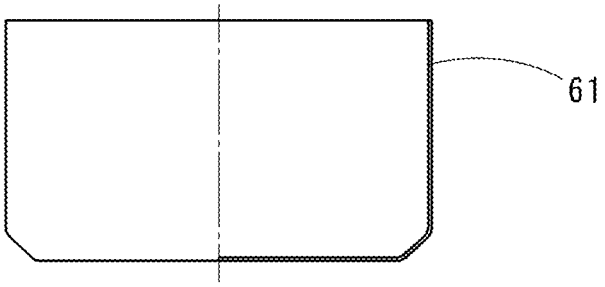
FIG. 6A, FIG. 6B and FIG. 6C each is a frontal view showing a first half in order of a manufacturing step of a can body in which a right half is made into a cross section.
Figure 6B:
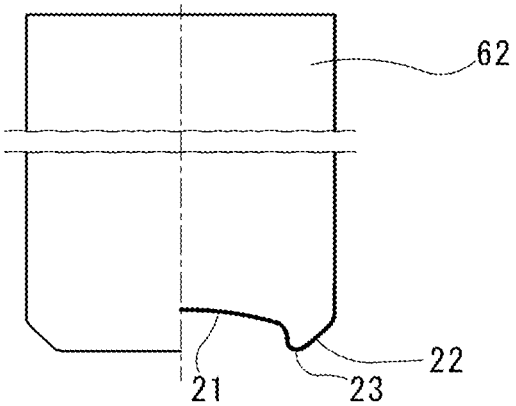

For manufacturing the can body 100 structured as above, at first, a cup 61 is formed by drawing a thin sheet of aluminum alloy or the like as shown in FIG. 6A, and then a cylindrical body 62 is formed from the cup 61 by drawing and ironing (DI machining) as shown in FIG. 6B. By this machining, the bottom part 20 is formed as well.

Figure 6C:
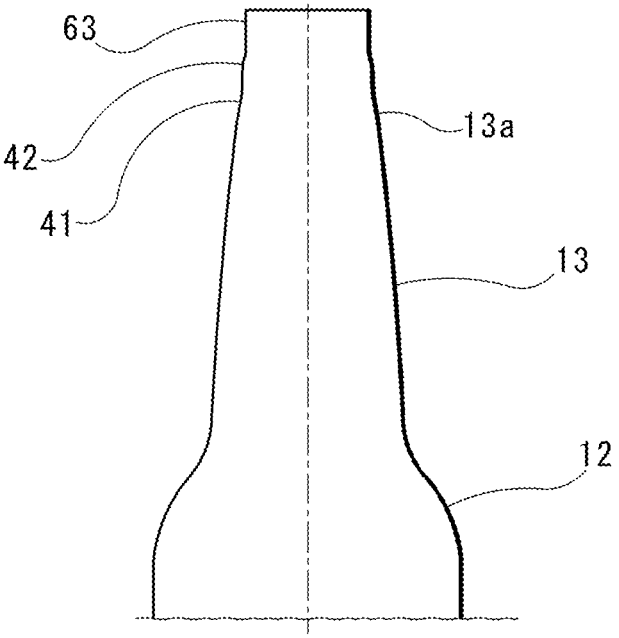

Consequently, an upper part of the cylindrical body 62 is reduced in the diameter by die-necking machining, as shown in FIG. 6C, the shoulder part 12 and the neck part 13 are formed. In the die-necking machining, a forming tool is moved along the can axis direction with pressing an opening end of the cylindrical body 62 toward the can bottom, so that the cylindrical body 62 is reduced in the diameter at the upper part than a middle position in a height direction to form the shoulder part 12, and the neck part 13 is formed above the shoulder part 12. The mouth part starting end part 41 is formed to be connected to the top end part 13*a* of the neck part 13, and a small-diameter cylindrical part 63 is formed on the upper end of the mouth part starting end part 41 intervening the inner peripheral-lower side bent part 42 with substantially a same outer diameter as the inner peripheral side cylindrical part 43 (a forming step of small-diameter cylindrical part).

Consequently, in the small-diameter cylindrical part 63, the curl part 50 is formed at the upper part than the part to be the inner peripheral side cylindrical part 43 by folding back an edge part including an edge of the small-diameter cylindrical part 63 to the outside in the radial direction to roll it in. This forming step of curl part has a pre-curling step of forming a pre-curl part 64 by folding back a vicinity of an edge of the small-diameter cylindrical part 63 to the outside in the radial direction with a specific radius of curvature; a rolling step of forming a roll part 65 by folding back and rounding an edge part of the small-diameter cylindrical part 63 in which the pre-curl part 64 is formed to the outside in the radial direction; and a throttle step of forming the curl part 50 having the outer peripheral-lower side bent part 56 which is convex diagonally downward by pressing an outer peripheral part of the roll part 65 from the outside in the radial direction after the rolling step. A series of machining for forming the curl part 50 is a die-necking machining to form by moving the forming tool in the can axis direction and pressing the opening end toward the can bottom.

(Pre-Curling Step)

Figure 7:
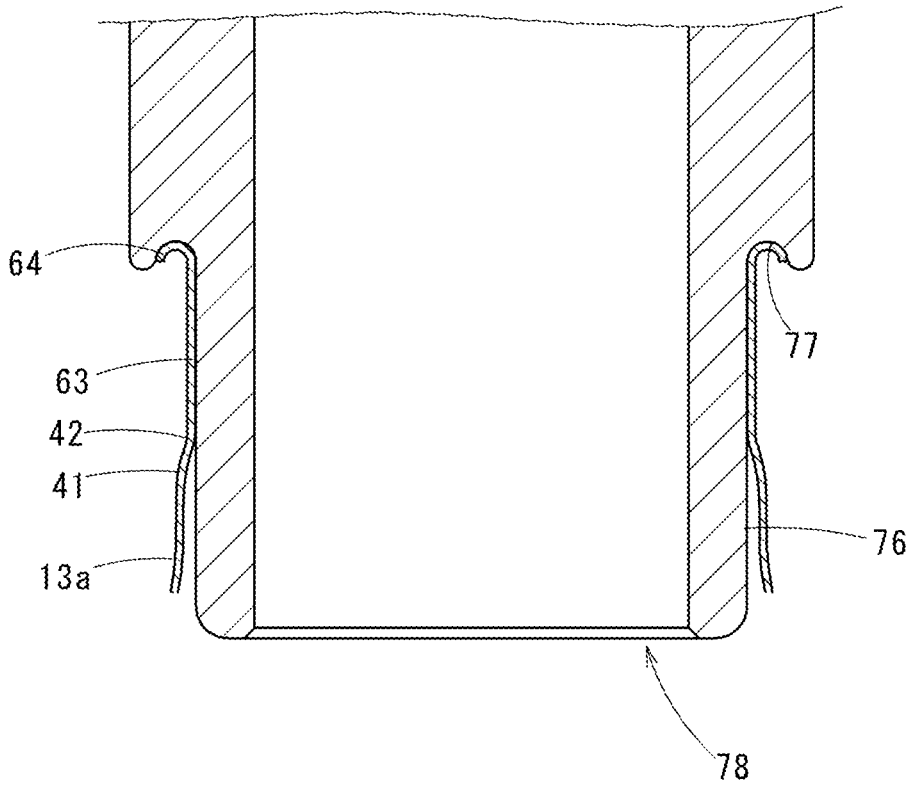
FIG. 7 is a cross sectional view showing a state of machining by a pre-curl mold in a pre-curl step.

A forming tool used in the pre-curling step is a pre-curl mold 78 provided with a guide part 76 inserted into the small-diameter cylindrical part 63 and a forming concave groove 77 formed in a ring-shape along the peripheral direction at a base end part of the guide part 76, as shown in FIG. 7. The forming concave groove 77 is formed in a semi-arc shape in the vertical cross section on an axis line (the can axis C). The guide part 76 of the pre-curl mold 78 is inserted into the small-diameter cylindrical part 63 by coaxially disposing the forming concave groove 77 and the small-diameter cylindrical part 63 in a state in which the forming concave groove 77 faces against the opening end of the small-diameter cylindrical part 63 and relatively moving them to approach each other along the can axis C; and the pre-curl part 64 is formed to be curled in the semi-arc shape at a vicinity of an edge of the small-diameter cylindrical part 63, by introducing the opening edge of the small-diameter cylindrical part 63 to the inner peripheral side of the forming concave groove 77 and reversing it along the inner peripheral surface of the forming concave groove 77. A radius of curvature of an outer surface of the pre-curl part 64 is preferably not less than 0.5 mm and not more than 1.8 mm (Rolling Step)

Figure 8:
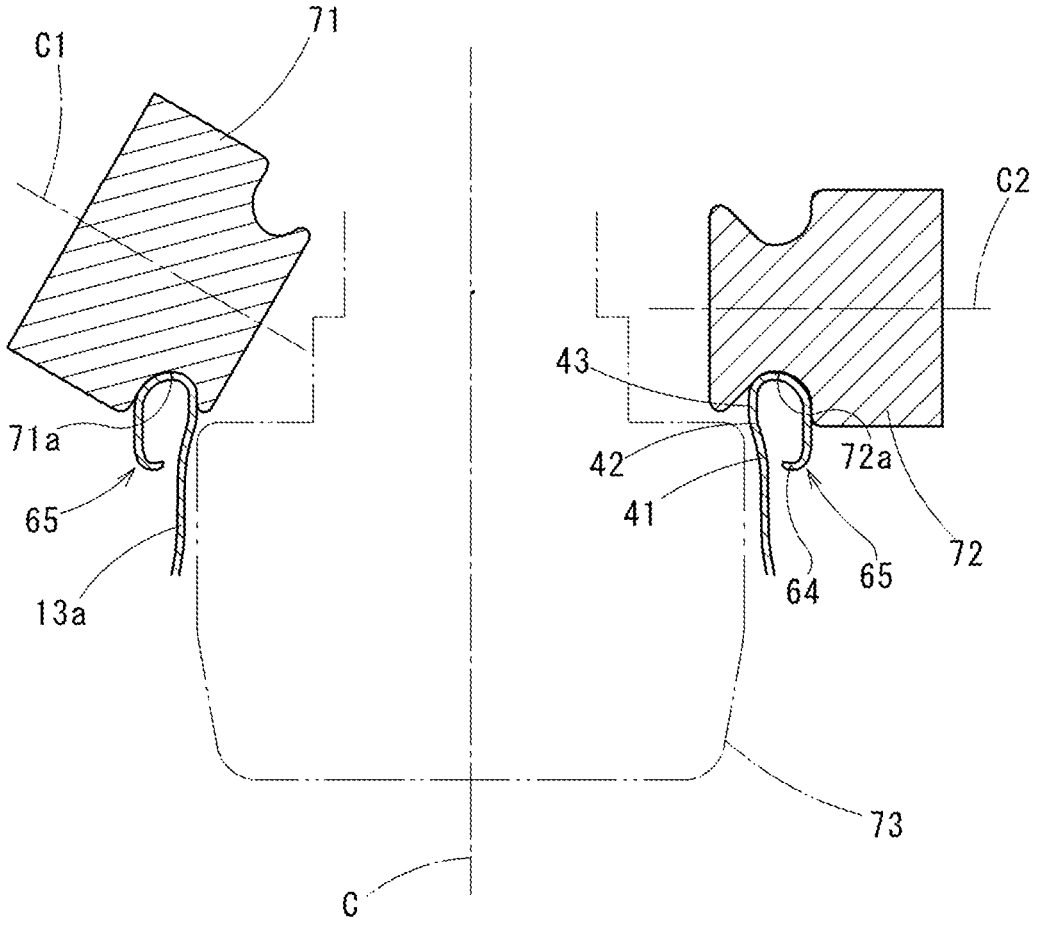
FIG. 8 is a cross sectional view showing a state of machining by a rolling tool in a rolling step.

In the rolling step, as shown in FIG. 8, two types of rolling tools 71 and 72 fold back the edge part of the small-diameter cylindrical part 63 and enlarge it in order to form the roll part 65 which is rounded and connected to the inner peripheral side cylindrical part 43. The rolling tools 71 and 72 are rotatable around axes C1 and C2 and have forming grooves 71*a* and 72*a* along a peripheral direction thereof. The rolling tools 71 and 72 turn around the small-diameter cylindrical part 63, and machine a lower part than the pre-curl part 64 in the small-diameter cylindrical part 63 to fold back it outside and round it by the forming grooves 71*a* and 72*a*. At this time, a core 73 is inserted inside the small-diameter cylindrical part 63 to support the small-diameter cylindrical part 63 from the inside.

The roll part 65 formed by this rolling machining has slightly a larger outline than a final shape of the curl part 50. In this stage, the pre-curl part 64 is formed at the end part of the roll part 65 and an edge is not in contact with the outer surface of the inner peripheral side cylindrical part 43.

(Throttle Step)

In the throttle step, the pre-curl part 64 including the edge is abutted on the outer peripheral surface of the small-diameter cylindrical part 63 to press it inward from the outside, so that the outer peripheral-upper side bent part 53, the concave part 58 connected to the outer peripheral-upper side bent part 53 and bent to be concave downward in the can axis direction, and the curl end part 57 which is connected to the concave part 58 and includes the edge are formed.

Figure 9:
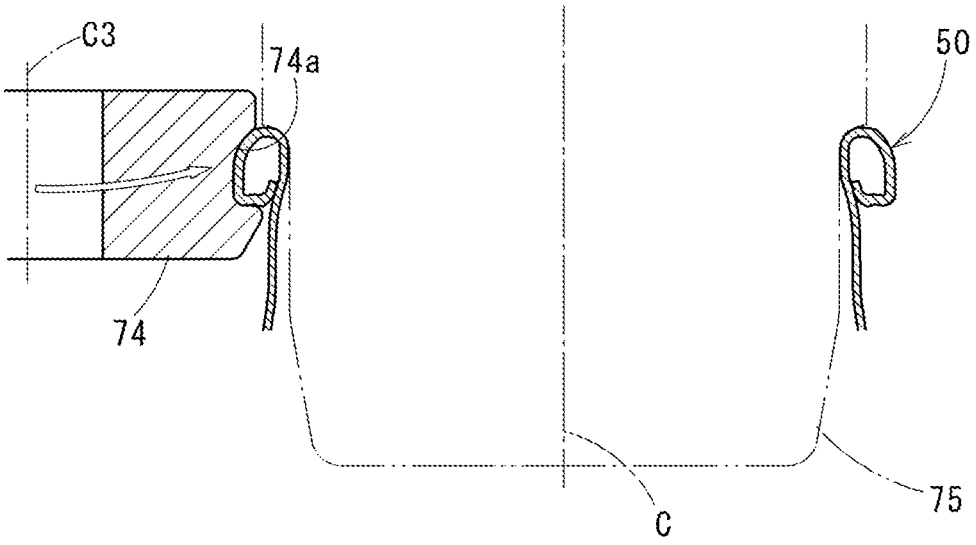
FIG. 9 is a cross sectional view showing a state of machining by a forming tool in a throttle step.

In the throttle step, a forming tool 74 shown in FIG. 9 is used. The forming tool 74 is rotatable around an axis C3, and a forming groove 74*a* is formed along the peripheral direction thereof. Swinging the axis C3, the forming groove 74*a* moves along a direction in which the forming groove 74*a* of the forming tool 74 moves away from or approaches the roll part 65.

The forming tool 74 moves on an arc line as shown by the white arrow in FIG. 9 to approach the roll part 65, and presses the outer peripheral part of the roll part 65 inward in the radial direction with lifting up from a diagonally lower side. Then, the forming tool 74 machines the roll part 65 by the forming groove 74*a* with revolving around the roll part 65. At this time as well, a core 75 is disposed inside the roll part 65 to support the roll part 65 from the inside.

Figure 10:
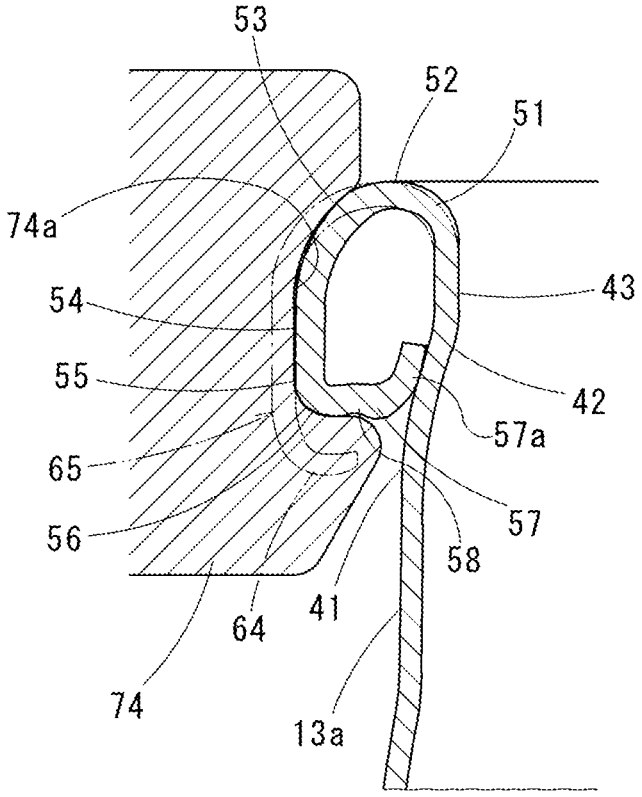
FIG. 10 is a cross sectional view enlarging an essential part of FIG. 9.

By the machining of the forming tool 74, mainly the outer peripheral part of the roll part 65 is formed as shown in FIG. 10; the folded top part 52, the outer peripheral-upper side bent part 53, the outer peripheral side cylindrical part 54, the outer peripheral-lower side bent part 56, the curl end part 57 including the end bent part 57*a*, and the concave part 58 are formed with connecting to the upper end of the inner peripheral side cylindrical part 43.

That is to say, by pressing the pre-curl part 64 against the outer surface of the mouth part starting end part 41, the roll part 65 is pressed in the radial direction; as shown in FIG. 10, the outer peripheral-upper side bent part 53 and the outer peripheral-lower side bent part 56 are respectively deformed into arc shapes with a small radius of curvature and it is deformed between the outer peripheral-lower side bent part 56 and the curl end part 57 as it is squashed, so that the concave part 58 is formed.

Thereby, the curl part 50 is formed in a state in which the outer surface of the end bent part 57*a* of the curl end part 57 is in contact with the outer peripheral surface of the mouth part starting end part 41.

The outer surface of the end bent part 57*a* of the curl end part 57 is curved to be convex, and the mouth part starting end part 41 is also formed to be a convex outer surface so that these convex outer surfaces are in contact with each other; therefore, forming defects are prevented such that the edge of the curl end part 57 bites the mouth part starting end part 41 or abuts against the outer peripheral surface of the mouth part starting end part 41 resulting the insufficient curl.

The can body 100 structured as above mentioned, as shown in FIG. 1, FIG. 4 and FIG. 5, becomes the bottle container 300 by attaching the cap 200 to the opening part 15 of the mouth part 14. Specifically, the can body 100 is filled with the contents, then the cap 200 is put on the mouth part 14. Then, in a state in which a top panel part 201 in which a seal material 205 is provided inside is compressed by pressing the cap 200 downward in the can axis direction from the upper side, a nail of the tool presses the skirt part 202 of the cap 200 inward in the radial direction, so that the skirt part 202 is deformed to follow the outer surface of the curl part 50. Thereby, the bottom end of the skirt part 202 is rolled up to be hooked on the bottom end of the curl part 50, and the cap 200 is attached to the can body 100.

The cap 200 is made of a thin metal sheet of aluminum or aluminum alloy in this embodiment and has the top panel part 201 which is a round sheet shape, the skirt part 202 extending vertically downward from an outer peripheral edge of the top panel part 201, a tab 203 protruding such that it broadens a part of a lower edge of the skirt part 202 in a surface direction, and the seal material 205 formed on the inner surface of the top panel part 201 and the upper edge part of the inner surface of the skirt part 202, as shown in FIG. 4 and FIG. 5. On the outer surfaces of the top panel part 201 and the skirt part 202, a pair of scores 206 are formed from both side edges of the tab 203 at the bottom edge of the skirt part 202, extending on the skirt part 202 and the top panel part 201.

In a state in which the cap 200 is mounted, the skirt part 202 wraps the curl part 50 from the bottom end of the outer peripheral side cylindrical part 54 to the bottom end of the outer peripheral-lower side bent part 56. The outer peripheral-lower side bent part 56 is provided to structure the maximum diameter part of the curl part 50; since the radius of curvature R6 thereof is small, the skirt part 202 is held on the outer peripheral-lower side bent part 56, so that the cap 200 is prevented from being off from the curl part 50.

The present invention is not limited to the above-described embodiments and various modifications may be made without departing from the scope of the present invention.

For example, the can body 100 of a circular cylindrical shape with a bottom in which the bottom part 20 and the trunk part 10 are integrally formed is explained in the above-described embodiment; however, it includes a can body without a bottom part, and a shape in which a bottom part formed separately is seamed in a trunk part after forming a curl part may be applicable.

INDUSTRIAL APPLICABILITY

In a can body, it is possible to fix a skirt part of a cap attached to a curl part by reliably rolling up, so that pressure resistance can be improved.

REFERENCE SIGNS LIST

10 Trunk part
11 Cylindrical part
12 Shoulder part
13 Neck part
13*a* Top end part
14 Mouth part
15 Opening part
20 Bottom part
21 Dome part
22 Heel part
23 Ground part
41 Mouth part starting end part
42 Inner peripheral-lower side bent part
43 Inner peripheral side cylindrical part
50 Curl part
51 Inner peripheral-upper side bent part
52 Folded top part
53 Outer peripheral-upper side bent part
54 Outer peripheral side cylindrical part
56 Outer peripheral-lower side bent part
57 Curl end part
57*a* End bent part
58 Concave part
59*a*, 59*b* Convex part
100 Can body
200 Cap
201 Top panel part
202 Skirt part
300 Bottle container

The invention claimed is:

1. A can body comprising:
a cylindrical part;
a neck part smaller than the cylindrical part in a diameter; and
a mouth part connected to the neck part, wherein
the mouth part comprises a curl part in which an end part of the mouth part including an edge is folded back outward in a radial direction and rolled up, said curl part being provided at an outer peripheral part of the mouth part,
on a vertical cross section parallel to an axial direction of the can body, the curl part is provided with:
a folded top part that is bent to protrude upward in the axial direction;
an outer peripheral-upper side bent part that is bent downward in the axial direction from an outer peripheral edge of the folded top part;
an outer peripheral side cylindrical part extending downward in a direction parallel to the axial direction from an outer peripheral edge of the outer peripheral-upper side bent part;
an outer peripheral-lower side bent part which is bent inward in the radial direction at an outer peripheral lower part of the outer peripheral side cylindrical part and convex diagonally downward in the axial direction;
a concave part which is connected to the outer peripheral-lower side bent part and concave downward in the axial direction; and
a curl end part which is connected to the concave part and includes the edge,
the outer peripheral-lower side bent part and the curl end part each have a convex part, respectively, which is convex downward in a direction parallel to the axial direction,
the concave part is located between the convex part of the outer peripheral-lower side bent part and the convex part of the curl end part,
a radius of curvature of an outer surface of the outer peripheral-lower side bent part is not less than 0.4 mm and not more than 1.2 mm,
a radius of curvature of an outer surface of the curl end part is not less than 1.0 mm and not more than 4.0 mm, and
a depth of the concave part in the axial direction measured from a line connecting top points of the convex part of the outer peripheral-lower side bent part and the convex part of the curl end part to a deepest part of the concave part is not less than 0.01 mm and not more than 0.30 mm.

2. The can body according to claim 1, wherein the curl end part has an end bent part whose diameter gradually reduces upward in the axial direction from the inside of the concave part in the radial direction, the end bent part being curved to be convex inward in the radial direction.

3. The can body according to claim 1, wherein a radius of curvature of an outer surface of the outer peripheral-lower side bent part is not less than 0.5 mm and not more than 0.8 mm.

4. The can body according to claim 1 further comprising:
an inner peripheral-lower side bent part; and
an inner peripheral side cylindrical part, wherein
the mouth part is provided with a mouth part starting end part connected to a top end part of the neck part and curved to swell out in the radial direction with a reducing diameter upward in the axial direction, the inner peripheral-lower side bent part is curved to convex inward in the radial direction from a top end of the mouth part starting end part, the inner peripheral side cylindrical part is connected to a top end of the inner peripheral-lower side bent part and extends vertically upward in the axial direction at an innermost position of the mouth part, and the curl part is connected to a top end of the inner peripheral side cylindrical part.

5. The can body according to claim 4, wherein a radius of curvature of an outer surface of the mouth part starting end part is not less than 6.3 mm and not more than 10.3 mm.

6. The can body according to claim 4, wherein a radius of curvature of an outer surface of the inner peripheral-lower side bent part is not less than 1.0 mm and not more than 5.0 mm.

7. The can body according to claim 4, wherein on the vertical cross section parallel to the axial direction, the curl part further includes an inner peripheral-upper side bent part bent to spread outward in the radial direction from a top end of the inner peripheral side cylindrical part, the folded top part is folded from an outer peripheral edge of the inner peripheral-upper side bent part; and the outer peripheral-lower side bent part continues to a lower end of the outer peripheral side cylindrical part.

8. The can body according to claim 7, wherein a radius of curvature of an outer surface of the inner peripheral-upper side bent part is not less than 0.8 mm and not more than 1.4 mm;

a radius of curvature R4 of an outer surface of the folded top part is not less than 1.5 mm and not more than 2.5 mm; and a radius of curvature of an outer surface of the outer peripheral-upper side bent part is not less than 2.4 mm and not more than 3.0 mm.

9. The can body according to claim 2, wherein a radius of curvature of a convex surface of the end bent part is not less than 0.8 mm and not more than 3.0 mm.

10. The can body according to claim 1 wherein a depth of the concave part in the axial direction is not less than 0.01 mm and not more than 0.20 mm.

11. The can body according to claim 1, wherein a ratio (T/D) of a thickness T (mm) of the curl part in the radius direction and an outer diameter D (mm) of the curl part is not less than 0.07 and not more than 0.12; and the thickness T is not less than 7% and not more than 12% of the outer diameter D.

12. The can body according to claim 1, wherein a width of the curl part in the axial direction is not less than 3.0 mm and not more than 5.0 mm.

13. The can body according to claim 1, wherein a width of the curl part in the axial direction is not less than 3.5 mm and not more than 4.7 mm.

* * * * *